United States Patent [19]

Tsujimoto et al.

[11] Patent Number: 4,776,095

[45] Date of Patent: Oct. 11, 1988

[54] HAIR CLIPPER

[75] Inventors: Mutsumi Tsujimoto; Koichi Iwanaga; Hideaki Haraguchi, all of Hikone, Japan

[73] Assignee: Matsushita Electric Works, Ltd., Japan

[21] Appl. No.: 920,266

[22] Filed: Oct. 17, 1986

[30] Foreign Application Priority Data

Nov. 14, 1985 [JP] Japan ..... 60-255346

[51] Int. Cl.[4] ..... B26B 19/20

[52] U.S. Cl. ..... 30/201; 30/233

[58] Field of Search ..... 30/200, 201, 202, 233, 30/241

[56] References Cited

U.S. PATENT DOCUMENTS

| | | | |
|---|---|---|---|
| 1,451,175 | 4/1923 | Nannini | 30/201 |
| 3,237,304 | 3/1966 | Merzon | 30/201 |
| 3,273,237 | 9/1966 | Barcaskey | 30/201 X |
| 3,648,370 | 3/1972 | Cercone | 30/201 |
| 4,085,503 | 4/1978 | Beck et al. | 30/201 X |
| 4,557,050 | 12/1985 | Haraguchi et al. | 30/201 X |

FOREIGN PATENT DOCUMENTS

| | | | |
|---|---|---|---|
| 0031351 | 3/1979 | Japan | 30/201 |

*Primary Examiner*—E. R. Kazenske
*Assistant Examiner*—Michael D. Folkerts
*Attorney, Agent, or Firm*—Stevens, Davis, Miller & Mosher

[57] ABSTRACT

An electric hair clipper includes a hair thinning comb attachment detachable to a housing provided with a cutter assembly. The comb attachment is formed with a row of hair guiding slots which is in parallel and juxtaposed relation with the cutting edge of the cutter assembly for guiding the hair past the cutting edge in the process of hair thinning operation. A rotary adjustor dial is mounted on the housing and is drivingly connected to the comb attachment for varying the relative position of the comb attachment to the housing and therefore the distance between the row of the hair guiding slots and the cutting edge, thus adjusting the cutting length of hair intended by simple manipulation of the rotary adjustor dial.

4 Claims, 6 Drawing Sheets

HAIR CLIPPER

BACKGROUND OF THE INVENTION

1. Field of the Invention

The present invention relates to a hair clipper having a function of thinning hair, and more particularly to such a hair clipper provided with a comb attachment for adjusting the cutting length of hair.

2. Description of the Prior Art

It is well known that an electric hair clipper is put to home or personal use for clipping human hair in view of its convenience-serving and cost-saving qualities. In particular, an electric hair clipper with hair thinning capability is useful for a person having inferior barbering skill because the hair thinning generally affords a more natural finish in appearance.

Such a hair clipper provided with a hair thinning comb attachment is illustrated and described as a part of the disclosure of U.S. Pat. No. 4,557,050 patented on Dec. 10, 1985 and issued to the same assignee of the present invention. The comb attachment in this patent is detachably connected to a housing mounting a cutting assembly at its front and is movable toward and away from the housing in order to vary the distance between the cutting edge of the cutter assembly and the leading edge of the comb attachment which is in use to be in guiding contact with the hair or skin of the user, thus adjusting the cutting length of the hair. To this end, the comb attachment is formed with a push button having a finger engageable with any one of slots formed in the housing. The slots are spaced apart along the sliding direction of the comb attachment so that the comb attachment is held at a desired distance from the housing by selectively engaging the finger into one of the longitudinally spaced slots. The push button is pivotally supported on the comb attachment and is biased by a spring in the direction of engaging the finger into the slot.

This engagement, however, requires rather complicated and inconvenient operation in changing the lengthwise position of the comb attachment with respect to the housing. That is, the push button is firstly pressed down to disengage the finger from the slot and is then pushed forward or backward as being kept pressed down in order to move the comb attachment toward or away from the housing. It is, therefore, confusing for a finger of the user to carry out the adjusting procedure with the push button especially when the hair clipper is in operation.

SUMMARY OF THE INVENTION

In view of the above problem, the present invention is designed to provide an electric hair clipper having a comb attachment capable of being moved by an improved adjusting mechanism to determine the cutting length of hair. The hair clipper comprises a housing provided at its front end with a cutter assembly comprising a toothed stationary blade and a toothed movable blade driven to reciprocate relative to the stationary blade and defining therewith an elongate cuting edge, and a detachable comb attachment detachably mounted to the front portion of the housing. The comb attachment is slotted at its front end to form a comb section in which a row of hair guiding slots is aligned in parallel and juxtaposed relationship with said cutting edge.

The characterizing feature of the present invention resides in that the comb attachment is driven to move toward and away from the housing by the operation of a rotary adjustor dial mounted on the housing. The comb attachment is drivingly connected to the rotary adjustor dial through linkage means which converts the rotary movement of the dial into the sliding movement of the comb attachment toward and away from the housing for adjusting the distance between the comb section of the comb attachment and the cutting edge of the cutter assembly. With this adjustment mechanism, a simple application of force to rotate the dial is enough to vary the relative position of the comb attachment to the housing for adjusting the cutting length of the hair, facilitating the adjustment even when the hair clipper is in operation.

Accordingly, it is a primary object of the present invention to provide an electric hair clipper with a comb attachment capable of adjusting the cutting length of the hair by a simple manipulation of the rotary adjustor dial.

In a preferred embodiment, the rotary adjustor dial is formed with a number of circumferentially spaced holes into any one of which a detent projection is biased to engage for releasably locking the comb attachment in positions relative to the housing. The engagement serves to stably hold the comb attachment in a desired position against possible fluctuation thereof, which is therefore another object of the present invention.

The linkage means comprises a pinion movable with the rotary adjustor dial and a bar having a rack for engagement with the pinion. The diameter of the pinion is properly dimensioned with respect to that of the rotary adjustor for the purpose of achieving an effective force transmission from the dial to the comb attachment, while preventing the accidental movement of the comb attachment. Practically, the diameter of the pinion is rendered smaller than that of the rotary adjustor. This produces the effect that a small application force to the rotary adjustor dial is multiplied to move the comb attachment, and conversely that a larger application force would be required for moving the comb attachment if applied to the comb attachment itself and not to the adjustor dial. This consequently assists the comb attachment in being held in a desired poition.

It is, therefore, a further object of the present invention to provide a hair clipper with a comb attachment in which the comb attachment is connected to the rotary adjustor dial in an effective force transmission manner.

The rotary dial is mounted on the housing with its axis of rotation perpendicular to the moving direction of the comb attachment so as to align the direction of the application force with the dial to the moving direction of the comb attachment, enhancing the operability in adjusting the position of the comb attachment.

It is therefore a still further object of the present invention to provide a hair clipper with a comb attachment which has an improved operability.

The rotary adjustor dial is mounted on the housing in a position transversely displaced from the center of the housing so that it can be easily manipulated by a single finger of the user's hand grasping the housing, which is therefore a further object of the present invention.

The present invention discloses a further useful feature of providing a plurality of cutting length indications on a linkage bar employed for driving connection between the pinion and the comb attachment, arranging one of the indications corresponding to the relative position of the comb attachment to be viewed through a window in the housing for confirmation by the user of the cutting length of the hair to be intended.

The above and other objects of the present invention will be more apparent in the following detailed description of preferred embodiments when taken in conjunction with the attached drawings.

DETAILED DESCRIPTION OF THE PREFERRED EMBODIMENT

Figure 1:
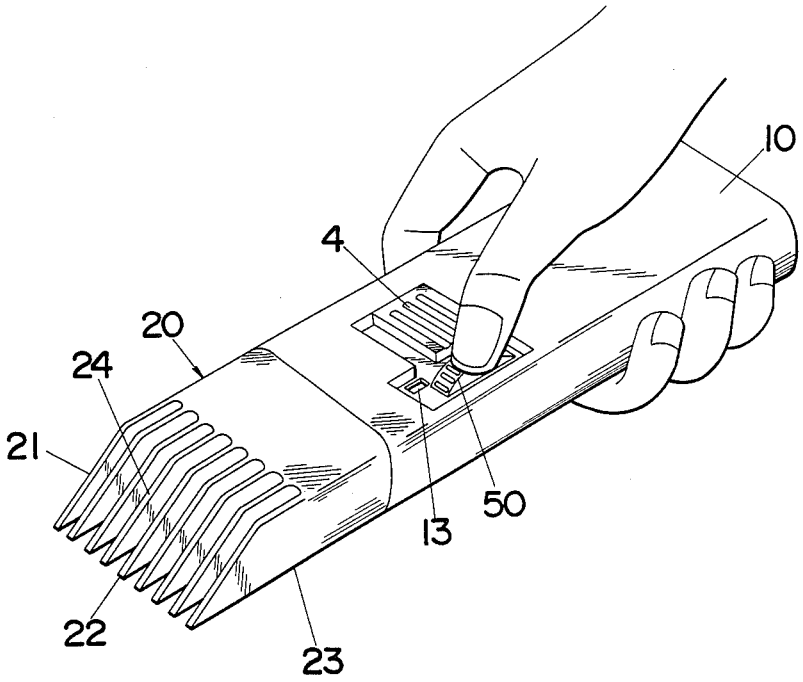
FIG. 1 is a perspective view of a hair clipper embodying the present invention.

Referring now to the drawings, there is illustrated a portable electric hair clipper in accordance with a preferred embodiment of the present invention. The hair clipper comprises a housing 10 provided at its front end with a cutter assembly 30 for shearing hair and a comb attachment 20 detachably mounted onto the front portion of the housing 10. The housing 10 is made of plastic material into an elongate configuration with a longitudinal axis and is formed at its front portion with a nose extension 11 which carries at its end the cutter assembly 30 and which slidably receives thereon the comb attachment 20.

Figure 2:
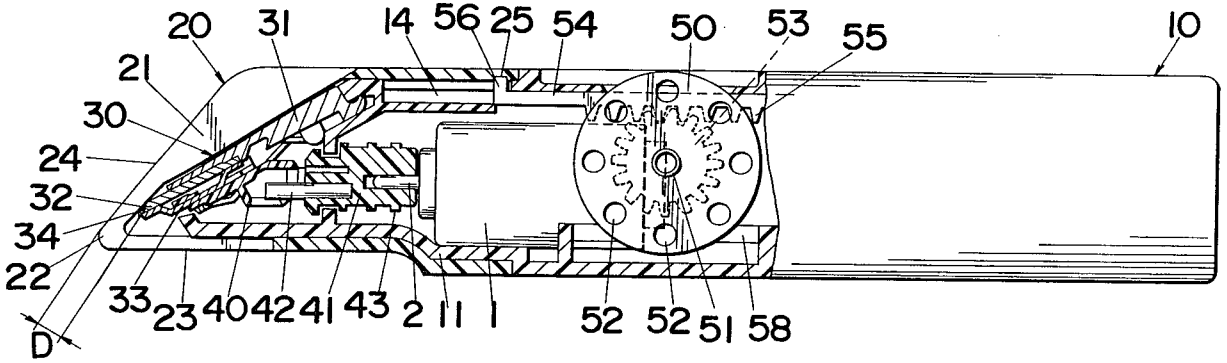
FIG. 2 is a side view, partly in section, of the hair clipper.
Figure 3:
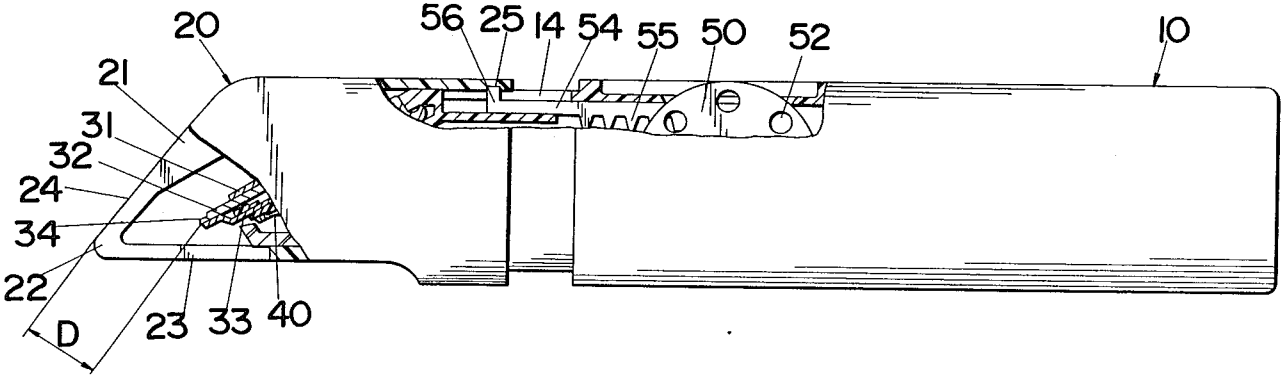
FIG. 3 is a side view, partly in section of the hair clipper.
Figure 4:
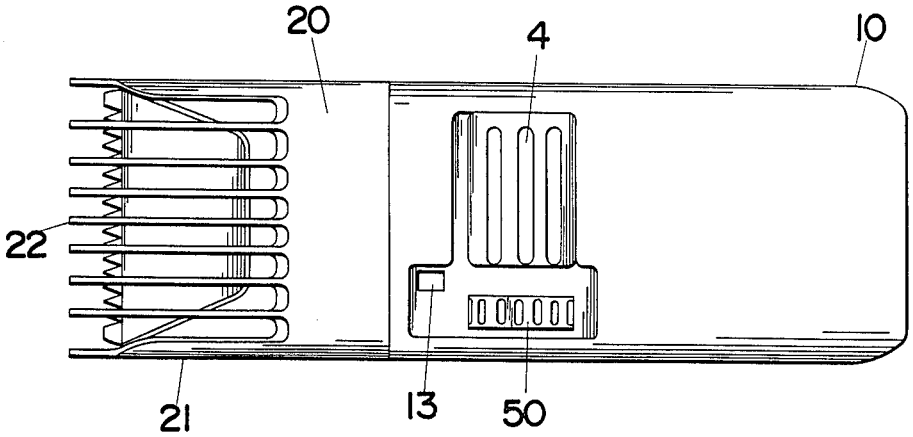
FIG. 4 is a top elevational view of the hair clipper with a comb attachment shown in a closest position to a housing of the hair clipper.
Figure 5:
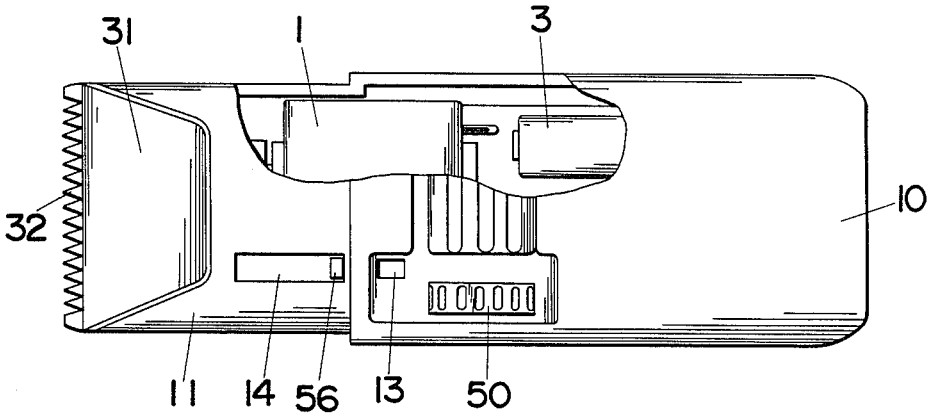
FIG. 5 is a top elevational view of the hair clipper with a portion broken away and with the comb attachment removed.

As illustrated in FIG. 2, the cutter assembly 30 comprises a toothed stationary blade 32 supported on a base plate 31 and a toothed movable blade 33 which is in slidable contact with the stationary blade 32 to define therebetween a cutting plane as well as define between the toothed edges thereof a cutting edge 34 exposed at the front extreme of the housing 10. The base plate 31 is fixedly received in a front opening of the nose extension 11 so that the cutting plane is inclined with respect to a plane normal to the longitudinal axis of the housing 10, and the cutting edge 34 extends transversely of the axis.

Mounted within the housing 10 is an electric motor 1 which has an output rotor shaft 2 drivingly connected through a drive member 41 to the movable blade 33 for reciprocation thereof. The drive member 41 is cooperative with a carrier 40 of the movable blade 33 for converting the rotary movement of the motor shaft 2 into a reciprocatory movement of the movable blade 33 and for this purpose has at its one end an eccentric shaft 42 which extends parallel to the motor shaft 2 fixedly connected to the other end of the drive member. The eccentric shaft 42 has its end connected loosely to a bearing of the carrier 40 to reciprocate the carrier together with the movabl blade 33 upon rotation of the motor shaft 2. The motor is powered by a rechargeable battery 3 mounted within the housing 10 rearwardly of the motor and is energized through the operation of a switch handle 4 slidably mounted on the upper wall of the housing 10. Formed on the drive member 41 is a helical fin 43 which develops a forward axial air flow therearound to thereby prevent the entry of clipped pieces of hair into the housing 10 as well as to cool the motor 1 and battery 3.

The comb attachment 20 is made of like plastic material into a cap-like configuration with a rear opening into which the extension 11 of the housing 10 is slidably fitted. The front portion of the comb attachment 20 is shaped to have a bottom flat surface 23 and a slanted flat surface 24, the bottom flat surface 23 being in substantially perpendicular to a plane normal to the axis of the housing 10, and the slanted flat surface 24 being inclined with respect to that plane so as to be at an acute angle to the bottom flat surface 23. Thus, the two surfaces 23 and 24 define therebetween a leading edge 22 which is in parallel with the cutting edge 34 of the cutter assembly 30. The front portion of the comb attachment 20 is slotted to have a row of hair reception slots each extending into the bottom and slanted flat surfaces 23 and 24 for guiding the hair past the cutting edge of the cutter assembly 30. For hair thinning operation, the hair clipper is manipulated with the leading edge 22 of the comb attachment 20 being kept in close adjoining relation or contact with the skin of the head in order to cut the hair by a length determined by the distance D between the leading edge 22 and the cutting edge 34. In other hair cutting operations, the above bottom or slanted surfaces 23 and 24 may be used as a hair contacting surface.

Figure 7:
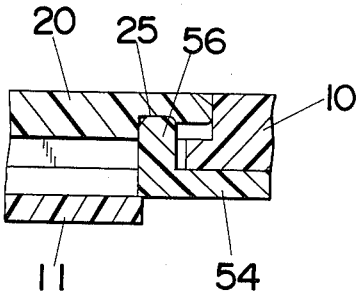
FIG. 7 is a fragmentary sectional view of the engaging portion between the comb attachment and a linking bar mounted on the side of the housing.

The comb attachment 20 is telescopically connected to the housing 10 by means of a linkage bar 54 slidably mounted in the housing 10 so that it can move toward and from the housing 10 for varying the distance between the leading edge 22 of the comb attachment 20 and the cutting edge 34. Integrally formed at the front end of the linkage bar 54 is a hook 56 which projects outwardly through a lengthwise slot 14 in the extension 11 for snap engagement with a recess 25 at the rear portion of the comb attachment 20, as best shown in FIG. 7. With this snap engagement, the comb attachment 20 can be readily detached from the housing 10 for use of the hair clipper without it.

Disposed on the side of the housing 10 adjacent to the switch handle 4 is a rotary adjustor dial 50 which is operatively connected to the comb attachment 20 by way of the linkage bar 54 for adjusting the distance between the leading edge 22 of the comb attachment and the cutting edge 34, i.e., the length of hair intended to be clipped off. The adjustor dial 50 is mounted on and partly within the housing 10 with its carrier shaft 51 journaled to the inside of the housing 10 to be rotatable about an axis perpendicular to the lengthwise axis of the housing 10, a portion of the adjustor dial 50 projecting outwardly through an opening 12 in the upper wall of the housing 10. A pinion 51 is fixedly and concentrically mounted onto the carrier shaft 51 to be rotatable with the rotary adjustor dial 50 and is assembled into meshing engagement with a rack 55 integrally formed on the rear portion of the linkage bar 54, effecting the sliding adjustment of the comb attachment 20 by simple manipulation of the adjustor dial 50, that is, merely by applying a unidirectional force to the adjustor dial 50 by a finger of the hand grasping the housing 10. With this result, the adjustment of the cutting length of the hair can be easily effected even in the hair thinning operation. It is noted at this point that the direction of the force applied to the dial is substantially coincident with the direction of the sliding movement of the comb attachment 20 for enhancing the operability of the hair clipper.

Figure 8:
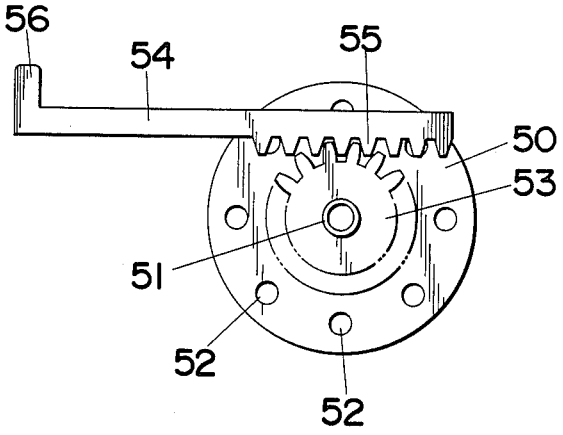
FIG. 8 is a side view of an engagement between a rack and a pinion employed as linking means for connecting the comb attachment to a rotary adjustor dial on the housing.
Figure 9:
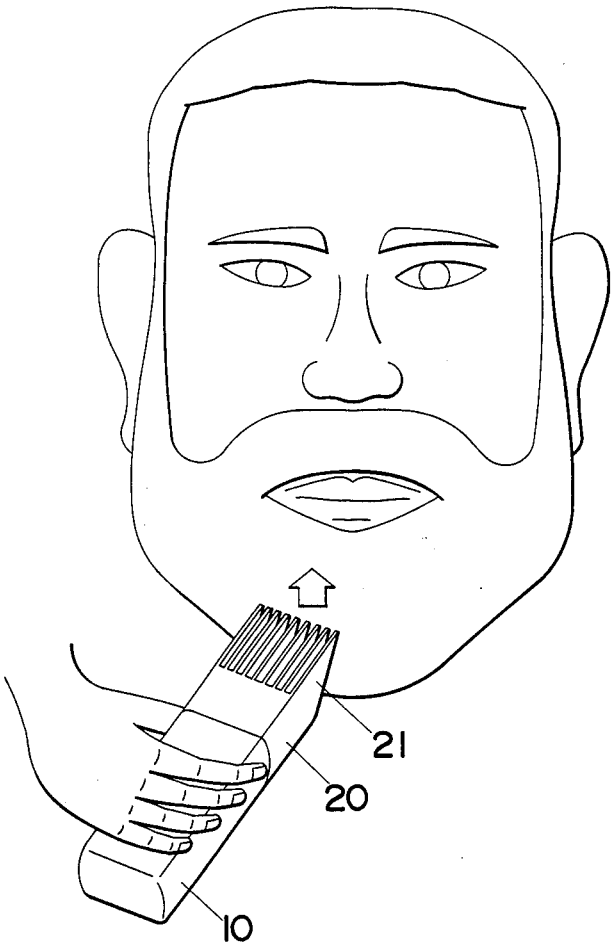
FIG. 9 is an explanatory view illustrating another example of using the hair clipper.

The adjustor dial 50 is formed with a number of axial holes 52 circumferentially spaced at a regular angular distance about its center axis. A detent projection 59 on a resilient plate 58 mounted within the housing 10 is urged into latching engagement with any one of the holes 52 so as to releasably lock the adjustor dial 50 or the comb attachment 20 in a desired position. In this connection, the adjustor dial 50 is designed to have the diameter approximately double that of the pinion, as shown in FIG. 8, so that a small application force to the dial 50 is enough to move the comb attachment 20 while the dial 50 is resistive to the force from the movement of the comb attachment 20, which assists the adjustor dial 50 in being locked in position.

Figure 6:
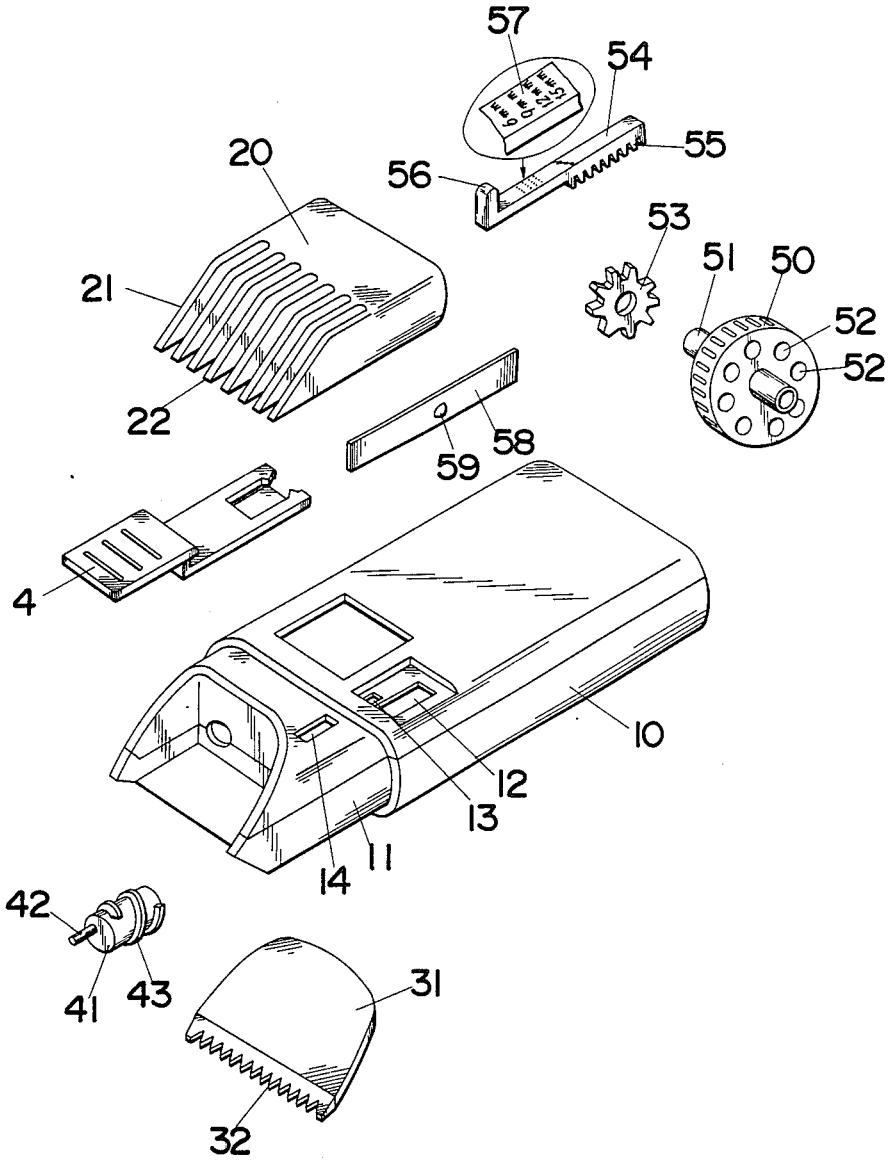
FIG. 6 is an exploded perspective view of the hair clipper.

As shown in FIG. 6, the linkage bar 54 has on a part thereof a plurality of cutting length indications 57 one of which is viewed through a window 13 formed in the wall of the housing 10 adjacent to the adjustor dial 50, so that the user can thereby easily confirm the cutting length of the hair intended prior to or during his hair thinning operation.

The adjustor dial 50 is disposed on the upper wall of the housing 10 at an offset position laterally displaced from the center so as to be within the reach of a single finger of the user's hand grasping the housing, facilitating the manual operation of the adjustor dial 50 even in the hair thinning operation.

The hair clipper of the present invention can be also manipulated for cutting the whiskers with the slanted surface of the comb attachment 20 being in sliding contact therewith.

What is claimed is:

1. A power driven hair clipper with a detachable comb attachment comprising:

an elongated housing having a top wall and two side walls and provided at its front end with a cutter assembly, said cutter assembly comprising a toothed stationary blade and a toothed movable blade driven to reciprocate relative to the stationary blade and defining therewith an elongate cutting edge;

a switch handle mounted on the top wall of the housing to be slidable in the lengthwise direction of the housing for movement between an ON position and an OFF position;

a comb attachment detachably attached to the housing, said comb attachment having a rear opening into which the front portion of the housing is slidably fitted, said comb attachment being formed at its front portion with a comb section having a row of hair guiding slots which is arranged in parallel and juxtaposed relationship with said cutting edge;

linkage means provided in the housing and having at one end of the linkage means a hook for detachable engagement with the comb attachment; and a rotary adjustor dial mounted on the housing and operatively connected to the other end of the linkage means such that rotary movement of the dial is converted into linear movement of the comb attachment toward and from the housing for adjustment of the distance between the row of hair guiding slots and the cutting edge of the cutter assembly, said rotary adjustor having its circumferential direction aligned in the direction of the movement of the comb attachment;

said rotary adjustor dial being mounted on the top wall of the housing in a side-by-side relation with said switch handle along the transverse direction of the housing, and said rotary adjustor dial being transversely displaced from the center of the housing so as to be disposed in closely adjacent relation with one of the side walls of the housing and in such a manner as to project the major portion of the dial into the interior of the housing wherein the linkage means comprises a pinion movable with the rotary adjustor dial and a linkage bar having at its one end said hook and having at the other end portion a rack for meshing engagement with the pinion.

2. A power driven hair clipper as set forth in claim 1, wherein said rotary adjustor is formed with a number of circumferentially spaced holes and wherein the housing is provided with a detent projection which is biased into any one of the holes for releasably locking the comb attachment in positions relative to the housing.

3. A power driven hair clipper as set forth in claim 1, wherein the diameter of the pinion is smaller than that of the rotary adjustor dial.

4. A power driven hair clipper as set forth in claim 1, wherein said linkage bar is provided with a number of cutting length indications each corresponding to the selected distance between the row of hair guiding slots and the cutting edge, and wherein the housing is formed with a window through which one of the indications is viewed for indication of the cutting length intended.

* * * * *